United States Patent [19]

Daikeler et al.

[11] 4,000,867

[45] Jan. 4, 1977

[54] CONTROL FOR THE RELEASE OF A PARACHUTE WITHIN A TOWED AIRCRAFT

[75] Inventors: Wolfgang Daikeler, Friedrichshafen; Horst Deppner, Langenargen, both of Germany

[73] Assignee: Dornier GmbH, Germany

[22] Filed: Jan. 20, 1976

[21] Appl. No.: 650,795

[30] Foreign Application Priority Data

Mar. 19, 1975 Germany ..... 2511984

[52] U.S. Cl. ..... 244/1 TD; 244/139; 244/147; 273/105.3

[51] Int. Cl.[2] ..... B64D 3/00; F41J 9/10

[58] Field of Search ..... 244/1 TD, 113, 3, 135 A, 244/147, 138 R, 139; 273/105.3; 343/707, 18 B, 18 C

[56] References Cited

FOREIGN PATENTS OR APPLICATIONS

| | | | |
|---|---|---|---|
| 1,519,116 | 2/1968 | France | 244/1 TD |
| 1,456,133 | 12/1968 | Germany | 244/1 TD |
| 156,075 | 9/1956 | Sweden | 273/105.3 |
| 737,318 | 9/1955 | United Kingdom | 273/105.3 |

*Primary Examiner*—Trygve M. Blix
*Assistant Examiner*—Galen L. Barefoot
*Attorney, Agent, or Firm*—James E. Bryan

[57] ABSTRACT

This invention relates to a control system for the release of a parachute contained within an aircraft adapted to be towed by a cable secured thereto, the cable being electrically conductive and having electrical contact to a control system in the aircraft, and an electrically conductive contact ring on the contour of the aircraft and being insulated with respect to the skin of the aircraft, whereby in case of separation of the cable from a towing aircraft, the cable touches the contact ring and closes a circuit composed of the contact ring, the cable, and the control system which releases the parachute.

4 Claims, 7 Drawing Figures

CONTROL FOR THE RELEASE OF A PARACHUTE WITHIN A TOWED AIRCRAFT

The present invention relates to a control for the release of a parachute contained within a towed aircraft adapted to be towed by an airplane or aircraft by mens of a cable, or a wire. Such towed aircraft are employed for the training of the operating personnel for anti-aircraft guns, and for testing weapons systems.

Known in the art are expendible towed aircraft which, after the unreeling of the towing cable thereof from the towing airplane, in the case of nondestruction thereof during firing are dropped at the end of the mission together with the towing cable as a loss item. Further known are towed aircraft adapted to be reemployed which, after use, are either retracted again by an active winch system within the towing airplane, or, after separation of the towing connection, are landed with the aid of a parachute.

It is the object of the present invention to automatically release the parachute within the towed aircraft whenever the towing connection is interrupted. This may be accomplished arbitrarily directly at the airplane (for example by cutting the towing wire), or unintentionally at any point of the towing connection (for example by the severing thereof as a result of firing).

This object is obtained, in accordance with the present invention, by virtue of the fact that the end of the towing cable or wire secured to the towed aircraft is electrically conducting and has electrical contact to a control wiring within the towed aircraft. At the contour of the towed aircraft is an electrically conducting contact ring insulated from the skin of the towed aircraft and, in case of the separation of the towing cable from the airplane, the cable touches the contact ring and closes a circuit composed of the contact ring, the towing cable, and the control wiring, thus releasing the parachute.

The cable section on the side of the towed aircraft predominantly tightened forwardly as a result of the tractive force during the towing phase will come to be positioned, after an interruption of the towing connection ahead of this cable section because of the mass and air resistance conditions of the towed aircraft and the cable section connected therewith, against the outer contour of the towed aircraft. The electric contact thereby produced between the metallic towing cable and the contact ring is used for the release of the parachute installed within the towed aircraft. One or several parachutes may be released simultaneously or successively.

Thus it is possible to automatically initiate the recovery of the towed aircraft without a specific signal communication between a ground station and the towing airplane, on the one hand, and the towed aircraft on the other hand, by separating the towing cable at the towing airplane, or in case of the severing of the towing connection. In the latter case, the danger to ground personnel caused by crashing towed aircraft is thus reduced.

According to another advantageous embodiment of the present invention, the aforedescribed parachute release system is combined with another release system to form a functionally redundant system. As an added releasing criterion serves in this case directly the tractive cable power which is measured in the connecting point of the cable at the towed aircraft. If the tractive cable power or force falls below a predetermined value over a specific period of time, the parachute will be released. By virtue of this measure, the automatic recovery of the towed aircraft is assured even if the towing cable breaks in proximity to the connecting point at the towed aircraft, and hence a touching of the contact ring is no longer possible.

A further advantageous embodiment of the present invention is the combination of the last-explained automatic-redundant releasing principle (indirectly influencable release) with a releasing possibility adapted to be directly influenced. Additionally required therefor is a command system in which the receiver may be installed in the towed aircraft, and the transmitter may be installed either on the ground or in the towing airplane. By way of this command path, the recovery system in the towed aircraft may be directly released, whereby with the ejection of the parachute, also the towing connection at the connecting point of the towing cable within the towed aircraft will be released. In this embodiment of the present invention, the automatic releasing system analogously operates as an emergency system only, and specifically if, for example, the towing connection breaks or if, during a malfunction of the command system, it is severed at the towing airplane.

Further embodiments and characteristics of the present invention will become apparent from the various figures of the accompanying drawings, which are described hereinbelow, and wherein FIG. 1 illustrates a towed aircraft in a cross-sectional view thereof with the functional principle of the automatic parachute release by way of a towing cable and contact ring;

Figure 1:
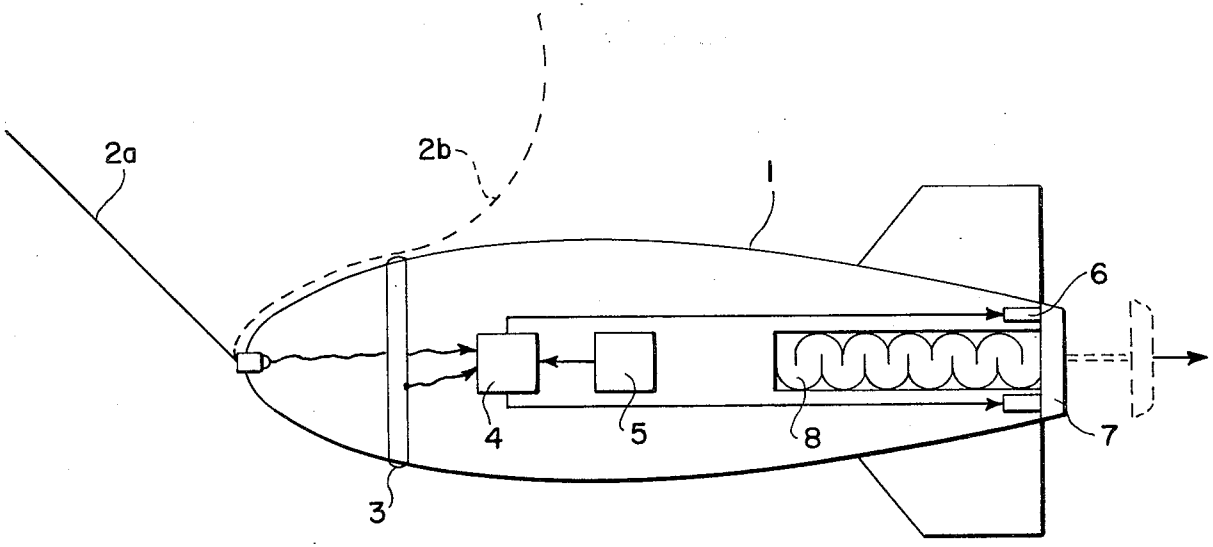

FIG. 1 illustrates an aerodynamically-shaped towed aircraft 1 with stabilizing fins and a parachute 8 installed in the tail. A metallic towing cable 2 is articulatedly connected in a rolling moment-free manner at the tip of the towed aircraft 1. During the stationary towing phase during horizontal flight, the cable 2 is tightened in the direction 2*a* by the tractive power or force. After the interruption of the towing connection to the towing airplane, the flexible cable will be positioned in the manner shown at 2*b*, against the contour of the towed aircraft and thus touches the metallic contact ring 3. The towing cable and contact ring are electrically connected with a control or relay wiring 4. By virtue of the touching of the towing cable 2 and the contact ring 3, the wiring 4, and therewith the parachute releasing device 6, are electrically activated. The power necessary therefor is supplied by a current supply unit 5, for example a battery carried within the towed aircraft. A pyrotechnically or electromagnetically-operating releasing device unlocks a covering cap 7 connected with the parachute 8, which cap 7 pulls the parachute, with the aid of aerodynamic forces acting upon the covering cap 7, out of the storage space in known manner. By means of the unfolding parachute, the towed aircraft is braked and landed together with the towing cable 2.

Figure 2:
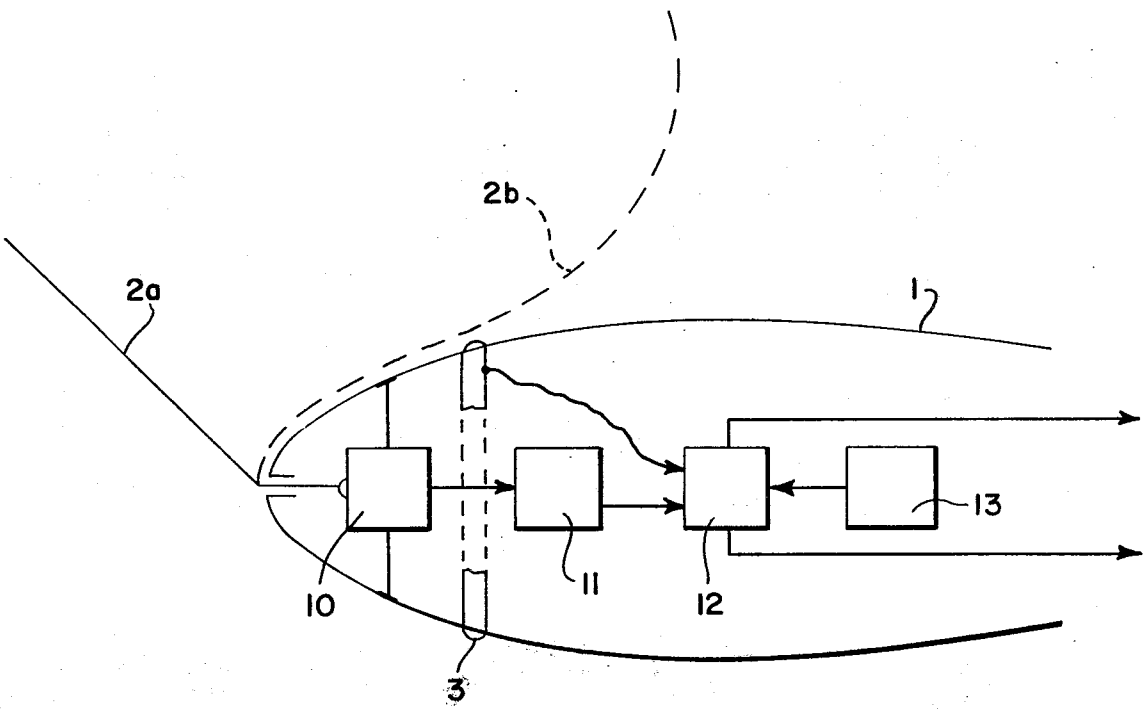
FIG. 2 illustrates the towed aircraft of FIG. 1 in a cross-sectional view thereof with the functional principle of an automatic-redundant parachute release by way of a contact ring and tractive cable power or force.

FIG. 2 illustrates the principle of the operation of a redundant parachute-releasing mechanism based on the concept described above. The tractive cable power or force acting upon the connecting point of the cable 2 at the towed aircraft 1 serves as an additional releasing criterion. It is measured with the aid of an appropriate device within the towed aircraft 1. If the tractive power or force falls below a predetermined minimum value, a tractive power threshold switch 10 is actuated which is connected to a delay network 11. The latter supplies an output signal to a control network 12 when the tractive cable power or force falls below the minimum value over a predetermined period of time. Connected to the control network 12 is also the contact ring 3. By means of an OR-switching of both control inputs, the parachute thus may be released either by way of the contact ring 3, as already described hereinbefore, or by way of the tractive power or force threshold value switch 10. Assured thereby is an automatic recovery even if the towing cable 2 breaks directly at the nose of the towed aircraft 1 due to interior or exterior influences so that a contact by way of the contact ring 3 is no longer possible. The delay network 11 connected to the tractive power threshold value switch 10 is intended to prevent that the parachute 8 is ejected already during brief tractive power or force breaks, for example due to the influence of gusts or squalls. A current supply 13 is necessary for the operation of the electrical parachute-releasing system.

Figure 3:
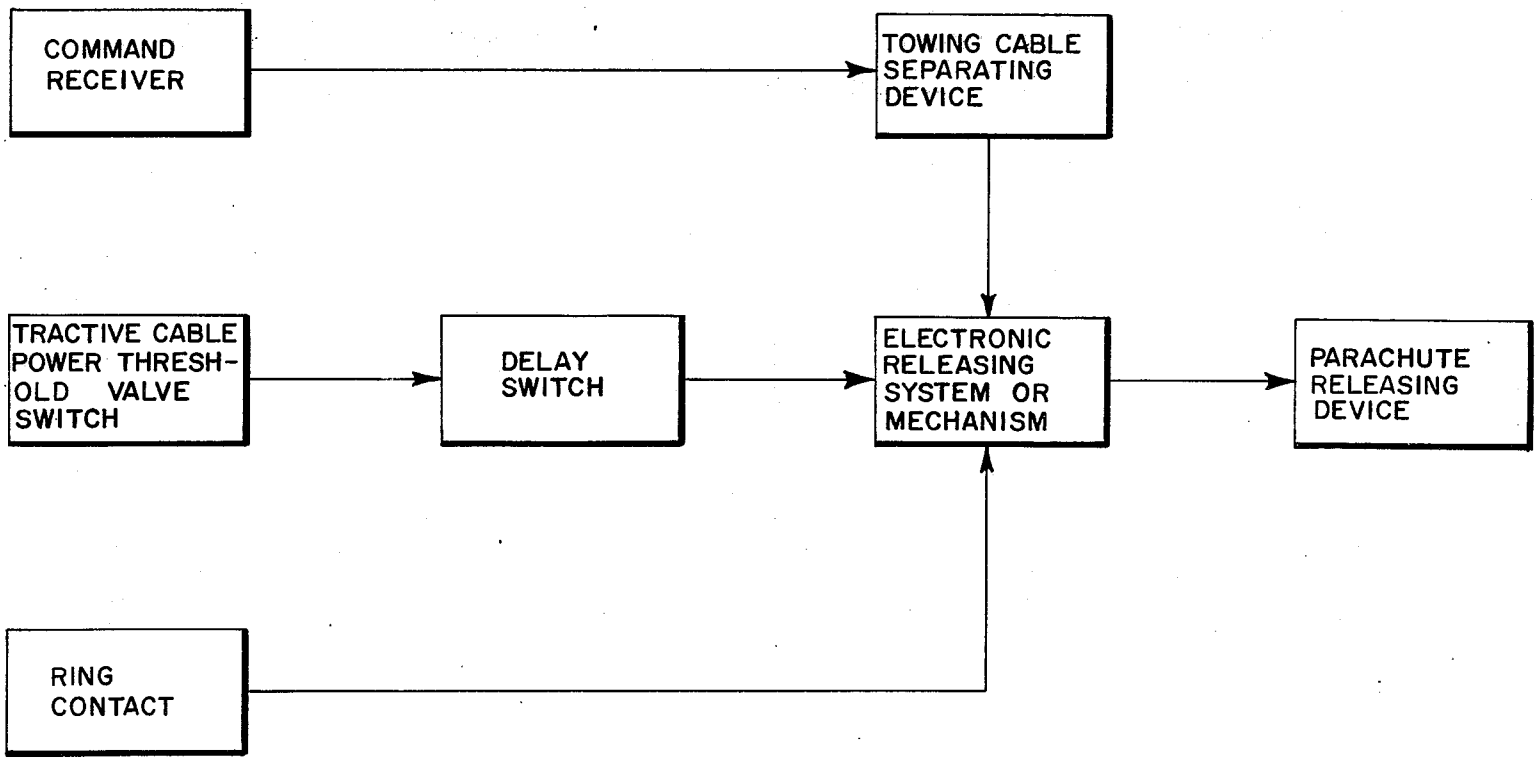
FIG. 3 is a block diagram ofthe recovery system with automatic and remote-controlled parachute release.
Figure 4A:
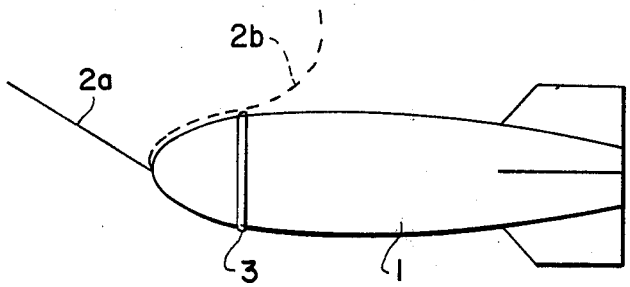
FIGS. 4*a*–4*d* illustrate various structural possibilities for the contact between the towing cable and the towed aircraft contact point.
Figure 4B:
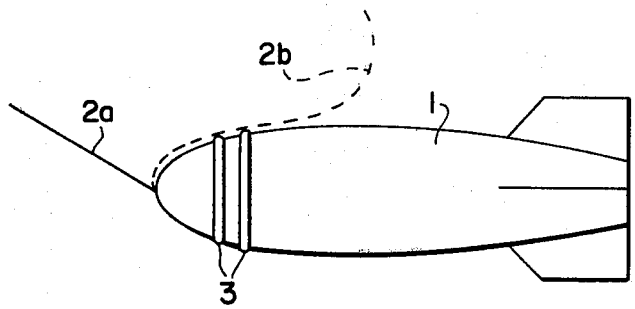
Figure 4C:
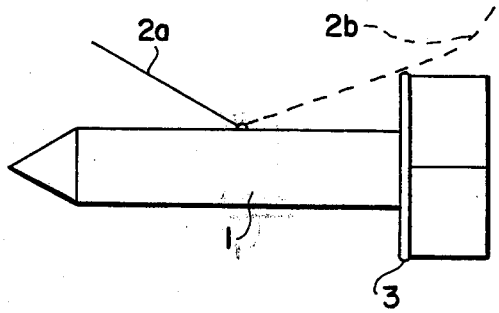
Figure 4D:
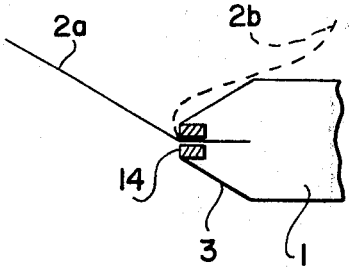

FIG. 3 shows the block diagram of the automatic/-redundant releasing principle explained hereinbefore, expanded by a possibility for directly releasing the parachute by way of a remote-control device, for example, a radio. For this purpose it is necessary that a command receiver be carried in the towed aircraft. The command signal received thereby for the initiation of the recovery procedure is supplied via a separating device for the towing cable to the control wiring and/or to the electronic releasing system for the ejection of the parachute.

FIG. 4 illustrates various structural possibilities for the electrical contact between the towing cable 2 and the towed aircraft envelope. Constructions *a* and *b* illustrate possibilities for providing one or several contact rings 3 in aerodynamically-shaped craft with connection of the towing cable at the nose. In the case of an electrically-insulating plastic skin on the towed aircraft, the contact ring may be mounted directly on the skin. In the case of a metallic skin, an insulated mounting is necessary. Construction *c* is conceivable, for example, in cylindrically-shaped, i.e. not convexly-shaped towed aircraft 1 wherein the towing cable 2 is connected in proximity to the center of gravity. The contact ring 3 is here placed about the tail unit. FIG. 4d shows a different construction of the contacting principle in metallic towed aircraft envelopes. In this case, the towing cable 2 is insulated with respect to the structure by means of the sleeve 14.

It will be obvious to those skilled in the art that many modifications may be made within the scope of the present invention without departing from the spirit thereof, and the invention includes all such modifications.

What is claimed is:

1. A control system for the release of a parachute contained within an aircraft adapted to be towed by cable means secured thereto, said cable means being electrically conductive and having electrical contact to a control wiring means in said aircraft, and electrically conductive contact ring means on the contour of said aircraft and being insulated with respect to the skin of said aircraft, whereby in case of separation of said cable means from a towing aircraft, said cable means touches said contact ring means and closes a circuit composed of said contact ring means, said cable means, and said control wiring means which releases said parachute.

2. A control system according to claim 1 including a tractive cable power threshold value switch means within said aircraft adapted to be towed, and delay element means connected to said switch means for automatic/redundant release of said parachute if a predetermined tractive power is not maintained over a predetermined period of time.

3. A control system according to claim 1 including command means for releasing said parachute by remote control.

4. A control system according to claim 1 in which said contact ring means is formed by an electrically conductive skin of said aircraft adapted to be towed, and said cable means is secured to said aircraft in an electrically insulated manner.

* * * * *